US005858073A

United States Patent [19]

Hine et al.

[11] Patent Number: 5,858,073

[45] Date of Patent: Jan. 12, 1999

[54] METHOD OF TREATING ELECTROLESS PLATING BATH

[75] Inventors: Fumio Hine, I Karuga Nara; Fujio Matsui, Hirakata, both of Japan

[73] Assignee: C. Uyemura & Co., Ltd., Osaka, Japan

[21] Appl. No.: 955,752

[22] Filed: Oct. 22, 1997

[30] Foreign Application Priority Data

Oct. 28, 1996 [JP] Japan ..... 8-302473

[51] Int. Cl.[6] ..... C23C 18/36

[52] U.S. Cl. ..... 106/1.22; 106/125; 106/127

[58] Field of Search ..... 106/1.22, 1.25, 106/1.27

[56] References Cited

U.S. PATENT DOCUMENTS

| | | | |
|---|---|---|---|
| 3,876,434 | 4/1975 | Dutkewych et al. | 106/1.27 |
| 5,112,392 | 5/1992 | Anderson et al. | 106/1.22 |
| 5,258,061 | 11/1993 | Martyak et al. | 106/1.27 |

*Primary Examiner*—Helene Klemanski

*Attorney, Agent, or Firm*—Sughrue, Mion, Zinn, Macpeak & Seas, PLLC

[57] ABSTRACT

Disclosed is a method of treating an electroless nickel plating bath mainly containing a water-soluble nickel salt, a complexing agent for complexing the nickel salt, and sodium hypophosphite as a reducing agent for reducing the nickel salt, including the steps of:repeatedly regenerating and reusing the electroless nickel plating bath in which a phosphite is accumulated by adding nickel sulfate to the plating bath to produce and precipitate nickel phosphite and separating the nickel phosphite from the plating bath; and adding sulfuric acid or a mixture of sulfuric acid and sodium sulfate to the nickel phosphite separated from the plating bath to convert the nickel phosphite into nickel sulfate and phosphorous acid or $NaH_2PO_3$, and recovering the nickel sulfate. According to this method, it is possible to simply, positively and inexpensively separate phosphite ions, without inclusion of any impurity, from an aged electroless plating bath in which phosphite ions are accumulated in a large amount, and to simply recover nickel sulfate from the nickel phosphite thus separated from the plating bath and effectively use the nickel sulfate as a reactive medium for removing a plating bath component or phosphite ions.

5 Claims, 1 Drawing Sheet

METHOD OF TREATING ELECTROLESS PLATING BATH

BACKGROUND OF THE INVENTION

The present invention relates to a method of treating an electroless plating bath, particularly an electroless nickel plating bath, containing hypophosphorous acid and/or a hypophosphite such as sodium hypophosphite as a reducing agent, which is capable of effectively treating nickel phosphite produced when the plating bath is regenerated and repeatedly using the plating bath without wastage.

Electroless plating, particularly electroless nickel plating (typically, electroless Ni—P plating) using sodium hypophosphite as a reducing agent has been used extensively in a variety of industrial fields. In the electroless plating of this type, metal ions are reduced by hypophosphite ions to be thus deposited on a substance to be plated.

Accordingly, with progress of plating, metal ions and hypophosphite ions in the plating bath are consumed, so that the deposition rate becomes smaller and/or the composition of deposit or plating film (for example, alloy contents of Ni and P for a Ni—P plating film) is changed. Therefore, plating is generally performed by compensating for the consumed metal ions and phosphite ions to keep concentrations thereof at the initial or predetermined values.

In the electroless plating, however, when metal ions are reduced by hypophosphite ions, the hypophosphite ions are simultaneously oxidized to produce phosphite ions ($H_2PO_3^-$), and the phosphite ions thus produced are gradually accumulated in the plating bath.

The phosphite ions ($H_2PO_3^-$) in a small amount little affect plating; however, when they are accumulated in a large amount, for example, in the range of 50–100 g/l or more, particularly, in higher than 150 g/l in concentration, they possibly exert adverse effect on plating. For example, by the effect of the phosphite ions accumulated in a large amount, the bonding strength between a plating film and a substrate may be weakened; the uniformity and corrosion resistance of the plating film may be degraded due to codeposition of the phosphite ions in the plating film; and in the worst case, the plating bath may be decomposed.

For this reason, in electroless Ni—P plating, an electroless Ni—P plating bath is generally discarded after used 3–10 turns. One turn is equivalent to a state in which the whole amount of nickel ions contained in the initial electroless Ni—P plating bath is consumed or deposited. For example, assuming that 6 g/l of nickel ions in concentration exists in a fresh solution or the initial electroless Ni—P plating bath, a state in which the nickel ions in an amount of 6 g/l are consumed or deposited is taken as one turn. Accordingly, 3–10 turns mean that the nickel ions in an amount of 18–60 g/l are consumed or deposited.

In addition to the problem that the service life of an electroless Ni—P plating bath is relatively short as described above, the Ni—P electroless plating has another industrial problem on waste water treatment accompanied by discard of the electroless Ni—P plating bath. To solve these problems, there have been proposed various methods of regenerating an electroless Ni—P plating bath. The related art regenerating methods, however, have been not extensively used because of disadvantages, for example, the complicated treatment, inclusion of impurity ions harmful to plating in the regenerated plating bath, or expensive system.

In view of the foregoing, the present inventors have proposed a method for regenerating an electroless nickel plating bath in Japanese Patent Laid-open No. Hei 5-247660. This method is characterized by regenerating an aged electroless nickel plating bath containing a water-soluble nickel salt, a complexing agent, and hypophosphorous acid or a hypophosphite as a reducing agent, and also containing 100 g/l or more of phosphite ions produced by oxidation of the hypophosphorous acid or hypophosphite with progress of plating. Specifically, the water-soluble nickel salt is added to the above aged plating bath at a ratio of 0.5 mol or more with respect to 1 mol of the above phosphite ions to produce and precipitate nickel phosphite, and the nickel phosphite thus precipitated is separated from the plating bath.

The above method, however, fails to examine the effective use of the nickel phosphite separated from the plating bath, and particularly to propose the effective recycle of the electroless plating bath.

SUMMARY OF THE INVENTION

An object of the present invention is to provide a method of treating an electroless plating bath containing hypophosphorous acid and/or a hypophosphite as a reducing agent, which is capable of effectively treating nickel phosphite produced when the plating bath is regenerated.

Another object of the present invention is to provide a method of treating an electroless nickel plating bath containing sodium hypophosphite as a reducing agent, which is capable of effectively treating nickel phosphite produced when the plating bath is regenerated, and repeatedly using the plating bath without wastage.

According to a first aspect of the present invention, there is provided a method of treating an electroless plating bath containing hypophosphorous acid and/or a hypophosphite as a reducing agent, comprising the steps of: adding a water-soluble nickel salt to the electroless plating bath in which phosphite ions are accumulated to produce and precipitate nickel phosphite, and separating the nickel phosphite from the plating bath; and adding sulfuric acid or a mixture of sulfuric acid and sodium sulfate to the nickel phosphite separated from the plating bath to convert the nickel phosphite into nickel sulfate and phosphorous acid or $NaH_2PO_3$, and recovering the nickel sulfate.

According to a second aspect of the present invention, there is provided a method of treating an electroless nickel plating bath mainly containing a water-soluble nickel salt, a complexing agent for complexing the nickel salt, and sodium hypophosphite as a reducing agent for reducing the nickel salt, comprising the steps of: repeatedly regenerating and reusing the electroless nickel plating bath in which a phosphite is accumulated by adding nickel sulfate to the plating bath to produce and precipitate nickel phosphite and separating the nickel phosphite from the plating bath; and adding sulfuric acid or a mixture of sulfuric acid and sodium sulfate to the nickel phosphite separated from the plating bath to convert the nickel phosphite into nickel sulfate and phosphorous acid or $NaH_2PO_3$, and recovering the nickel sulfate.

In the above method according to the second aspect of the present invention, it is effective to use the nickel sulfate recovered by adding sulfuric acid or the mixture of sulfuric acid and sodium sulfate to the nickel phosphite as a raw material to be added to the plating bath for converting the phosphite into nickel phosphite. Furthermore, to repeatedly use the electroless nickel plating bath, it is recommended that the plating bath from which the nickel phosphite is separated is cooled to a temperature lower than room temperature to precipitate sodium sulfate from the plating bath, and sodium sulfate is separated from the plating bath. The separated sodium sulfate can be used as a raw material for converting nickel phosphite to $NaH_2PO_3$.

More specifically, the present invention has been accomplished on the basis of knowledges, founded by the present inventors, that when sulfuric acid or a mixture of sulfuric acid and sodium sulfate is added to nickel phosphite, nickel phosphite is converted into nickel sulfate and phosphorous acid or $NaH_2PO_3$ and that the nickel sulfate thus obtained can be used as a water-soluble nickel salt constituting the electroless plating bath or a water-soluble nickel salt for precipitating nickel phosphite.

According to the present invention, it is possible to simply, positively and inexpensively separate phosphite ions, without inclusion of any impurity, from an aged electroless plating bath in which phosphite ions are accumulated in a large amount, and to simply recover nickel sulfate from the nickel phosphite thus separated from the plating bath and effectively use the nickel sulfate as an electroless nickel plating bath component or a reactive medium for removing phosphite ions.

BRIEF DESCRIPTION OF THE DRAWING

The present invention will be more clearly understood with reference to the following drawing: in which.

DETAILED DESCRIPTION OF THE PREFERRED EMBODIMENTS

Figure 1:
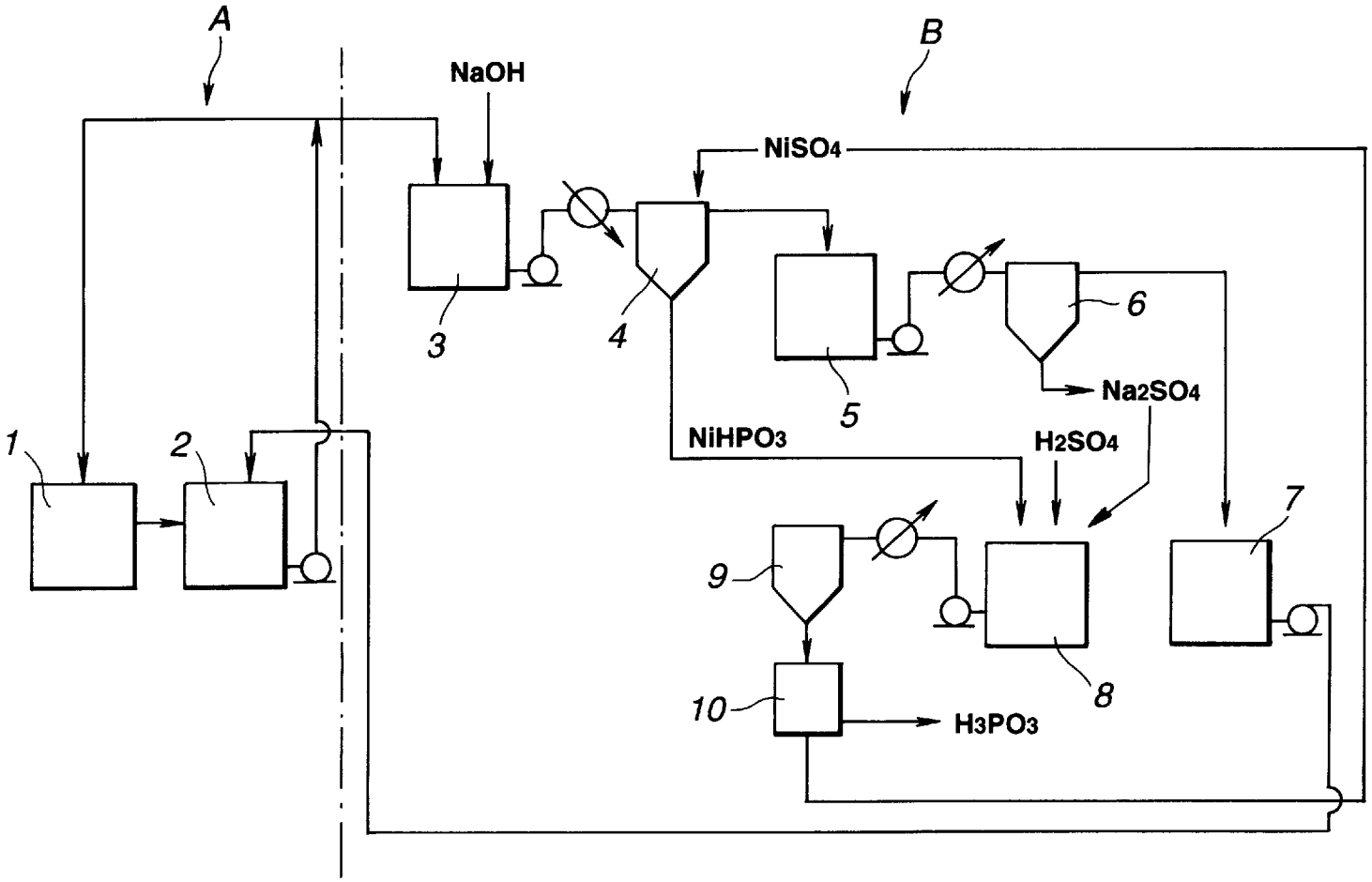
FIG. 1 is a flow chart illustrating one example of the present invention.

The present invention can be applied to any electroless plating bath, insofar as it mainly contains a water-soluble salt of a metal to be deposited, a complexing agent for complexing the salt, and hypophosphorous acid and/or a hypophosphite as a reducing agent, and preferably, it may be of a continuous service type in which a sulfate of the metal, sodium hypophosphite, and sodium hydroxide as a pH adjusting agent are supplied into the plating bath in order to compensate the consumed metal ions and phosphite ions to keep concentrations thereof at the initial or predetermined values and the bath pH to keep the initial or predetermined pH.

Specific examples of the electroless plating baths to which the present invention is applied include a single metal electroless plating bath containing a water-soluble salt of nickel, cobalt or copper; and an alloy electroless plating bath containing a water-soluble salt of Ni—Co alloy, Ni—Cu alloy, Ni—Co alloy, or Co—W alloy. In particular, the present invention is suitable to an electroless nickel plating bath or an electroless nickel alloy plating bath. The above electroless plating bath may be of an acidic, neutral, or alkaline type; and it may have any one of the known compositions. In particular, the present invention is suitable to an acidic bath in the pH range of 3.5 to 6.5.

The electroless nickel plating bath mainly contains nickel sulfate; the known complexing agent for complexing a nickel salt, for example, a carboxylic acid such as citric acid, succinic acid, malic acid, acetic acid, or lactic acid, and a salt thereof; and sodium hypophosphite. The concentrations of these components may be in the known ranges. For example, the concentration of nickel sulfate may be in the range of 0.05 to 0.3 mol/l; the concentration of the complexing agent may be in the range of 1 to 5 mol/l with respect to 1 mol/l of nickel sulfate; and the concentration of sodium hypophosphite may be in the range of 10 to 90 g/l. In addition, a stabilizer, a pH adjusting agent and the like can be added to the plating bath, and the pH of the electroless nickel plating bath can be alkaline or acidic. In general, the pH of the plating bath of the continuous service type may be in the range of 3.5 to 6.5, preferably, in the range of 4 to 6.

The plating using the above electroless nickel plating bath can be carried out in accordance with the known process. As plating proceeds, nickel ions and hypophosphite ions in the plating bath are consumed and the pH of the plating bath is lowered. Accordingly, nickel sulfate and sodium hypophosphite are continuously or intermittently added to the plating bath and also a pH increasing agent such as sodium hydroxide is added to the plating bath for keeping the concentrations of the nickel ions and hypophosphite ions and the pH in the plating bath at specific values. With this treatment, a desirable electroless plating can be carried out for a long period of time. In the case where phosphite ions produced by oxidation of hypophosphite ions are accumulated in the plating bath, they are removed in the following treatment.

According to the treatment of the present invention, when a phosphite (phosphite ions $H_2PO_3^-$) produced by consumption (oxidation) of hypophosphite ions $H_2PO_2^-$ is accumulated in the plating bath by the use of the plating bath in the manner described above, the plating bath is regenerated. It is to be noted that the regenerating timing may be suitably, but not exclusively, selected. In general, regeneration may be performed for the plating bath in which phosphite ions are accumulated in an amount of 50 g/l or more, preferably, 100 g/l or more, and particularly, in an amount of 150 g/l or more, or in some cases, 200 g/l or more. The regeneration of the plating bath is performed by adding, to the plating bath, a sulfate of a metal which is identical to the metal or at least one metal constituting an electroless plating film deposited from the electroless plating bath. For an electroless nickel plating bath, nickel sulfate is added to the plating bath at a metal ion concentration higher than that at the time of plating work.

Specifically, in this treatment, the metal sulfate may be added at a metal ion concentration higher than the metal ion concentration in the usual plating work of the plating bath (usual plating control metal ion concentration). In particular, the additive may be added at a metal ion concentration by weight which is more than 1 time, preferably, 1.2–10 times, more preferably, 1.5–6 times higher than the plating control ion concentration in order to produce and precipitate a difficultly soluble or insoluble phosphite. For an electroless nickel plating bath, the nickel sulfate may be added at a rate of 0.5 mol or more, preferably, 1 mol or more with respect to 1 mol of phosphite ions.

To effectively precipitate insoluble nickel phosphite, the addition of nickel sulfate may be accompanied by either or both of operations of increasing the temperature of the electroless plating bath to a value higher than the plating work temperature (usual plating control temperature) and of increasing the pH of the electroless plating bath to a value higher than the pH in plating work (usual plating control pH).

In the former operation, the temperature of the electroless plating bath may be increased to a value being 5° C. higher than the usual plating control temperature. For example, since the usual acidic type electroless nickel plating bath is generally heated at 90° C., the temperature of the plating bath may be increased to a value of 95° C. or more, preferably, 97° C. or more, and in some cases, it may be increased to the boiling point. On the other hand, in the latter operation, the pH of the electroless plating bath may be increased to a value being 0.1 or more, preferably, 1 or more higher than the usual plating control pH. For an acidic type electroless plating bath having the pH of 4 to 6, the pH of the plating bath may be increased to a value of 4.5 to 12, preferably, 7 to 10, more preferably, 8 to 9.

The pH adjustment is important to effectively produce and precipitate insoluble nickel phosphite. Specifically, in electroless plating, phosphite ions ($H_2PO_3^-$) are produced by oxidation of hypophosphite ions ($HPO_3^{2-}$) in accordance with the reaction shown below, and the phosphite ions ($H_2PO_3^-$) are converted into $H_3PO_3$ or $HPO_3^{2-}$ depending on the solution pH. In this case, since $HPO_3^{2-}$ reacts with $Ni^{2+}$ to precipitate insoluble nickel phosphite, the above-described pH adjustment is applicable.

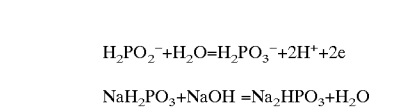

$$H_2PO_2^- + H_2O = H_2PO_3^- + 2H^+ + 2e$$

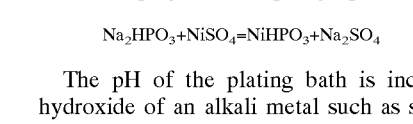

$$NaH_2PO_3 + NaOH = Na_2HPO_3 + H_2O$$

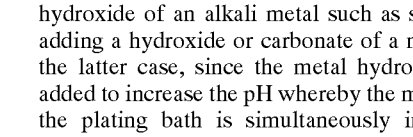

$$Na_2HPO_3 + NiSO_4 = NiHPO_3 + Na_2SO_4$$

The pH of the plating bath is increased by adding a hydroxide of an alkali metal such as sodium hydroxide or adding a hydroxide or carbonate of a metal to be plated. In the latter case, since the metal hydroxide or carbonate is added to increase the pH whereby the metal concentration in the plating bath is simultaneously increased, the added amount of the metal sulfate may be smaller as compared with the above-described addition of nickel sulfate.

In the case of increasing the pH, the temperature of the plating bath may be set at room temperature; however, it is preferably kept at the temperature range of 40° to 90° C., preferably, 50° to 70° C.

In each of the above treatments, the plating bath is agitated as needed and is left as it is for producing and precipitating a difficultly soluble or insoluble phosphite salt. In this case, the leaving time may be in the range of 0.5 to 24 hr, preferably, in the range of1 to 5 hr.

The precipitates thus produced can be separated or removed by the conventional manner such as filtration. The filtration may be performed at a high temperature. There may be provided a separate reservoir and plural filters near the plating tank. In this case, the precipitates can be produced and filtered in the reservoir during the plating tank remains at rest.

The electroless plating bath thus regenerated is adjusted the concentrations of metal ions and hypophosphite ions as well as the pH. Such an electroless plating bath can be similarly used again for plating. When phosphite ions are accumulated again in this electroless plating bath, it is regenerated by the same manner as described above. Thus, the electroless plating bath can be used repeatedly, and thereby the service life of the electroless plating bath can be prolonged.

On the other hand, sulfuric acid or a mixture of sulfuric acid and sodium sulfate is added to the separated nickel phosphite ($NiHPO_3$) to convert it into nickel sulfate and phosphorous acid or $NaH_2PO_3$ by the following reaction (i) or (ii).

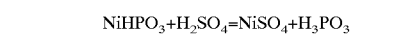

$$NiHPO_3 + H_2SO_4 = NiSO_4 + H_3PO_3 \quad \text{(i)}$$

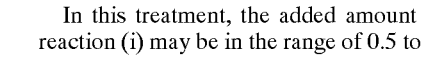

$$NiHPO_3 + \tfrac{1}{2}H_2SO_4 + \tfrac{1}{2}Na_2SO_4 = NiSO_4 + NaH_2PO_3 \quad \text{(ii)}$$

In this treatment, the added amount of sulfuric acid for reaction (i) may be in the range of 0.5 to 1.2 mol, preferably, 0.7 to 1.0 mol with respect to 1 mol of nickel phosphite. When the added amount of sulfuric acid is smaller than the above lower limit, the dissolution of nickel phosphite is retarded; while when it is larger than the upper limit, a large amount of a pH adjusting agent may be required when nickel sulfate is reused after being separated from phosphorous acid.

As for sulfuric acid used in this treatment, there is preferably used diluted sulfuric acid of 5–20 wt %, preferably, 10–15 wt % in concentration.

For reaction (ii), sulfuric acid and sodium sulfate may be used substantially in equimolar amounts. The total amount of sulfuric acid and sodium sulfate may be in the range of 0.5 to 1.2 mol, preferably, 0.7 to 1.0 mol with respect to 1 mol of nickel phosphite. Sodium sulfate may be used by dissolving diluted sulfuric acid of 5–20 wt %, preferably, 10–15 wt % in concentration.

The treatment for producing nickel sulfate and phosphorous acid or $NaH_2PO_3$ by adding sulfuric acid or a mixture of sulfuric acid and sodium sulfate to nickel phosphite and separating the obtained nickel sulfate from the phosphorous acid or $NaH_2PO_3$ may be performed by the conventional crystallization technique utilizing a difference in water solubility between nickel sulfate and phosphorous acid or $NaH_2PO_3$.

The nickel sulfate thus separated can be used as a component of a plating bath; however, if not sufficiently refined, it is preferably used as a raw material for producing and precipitating the above nickel phosphite. The phosphorous acid or $NaH_2PO_3$ separated from the nickel sulfate is discharged out of the system.

When nickel sulfate obtained from the above procedure is used as a raw material for producing and precipitating nickel phosphite from sodium phosphite, the procedure according to reaction (ii) is recommended. The nickel sulfate resulted from the procedure according to reaction (i) may contain or adhere to phosphorus acid which is a strong acid. The use of such nickel sulfate requires a larger amount of sodium hydroxide in order to neutralize the contained phosphorus acid in the nickel phosphite forming step.

The use of the nickel sulfate resulted from the procedure according to reaction (ii) does not require the neutralization even if the nickel sulfate contains or adheres to sodium phosphite. The amount of sodium hydroxide is just only the amount required for producing nickel phosphite according to the following reaction.

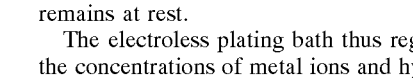

$$NiSO_4 + NaH_2PO_3 + NaOH = NiHPO_3 + Na_2SO_4 + H_2O$$

The sulfuric acid used for the above reaction (i) or (ii) is consumed and thus the running cost is required for the use of sulfuric acid. On the other hand, the use of sodium sulfate does not require the running cost when sodium sulfate obtained from the regenerating treatment of the electroless plating bath is utilized. Accordingly, since the amount of sulfuric acid in the procedure of reaction (ii) is about a half of that in the procedure of reaction (i), the cost can be decreased and the waste product can be decreased, whereby an economical and environment effects are improved.

Although the plating bath from which the above nickel sulfate is separated is regenerated and reused as described above, sodium sulfate is gradually accumulated in such a plating bath repeatedly regenerated and reused.

Specifically, an electroless nickel plating bath mainly containing nickel sulfate, a complexing agent, and sodium hypophosphite is continuously used by adding nickel sulfate, sodium hypophosphite and sodium hydroxide as a pH adjusting agent for compensating for the consumed nickel ions and hypophosphite ions and the lowered pH of the plating bath as plating proceeds. As a result, with progress of plating, not only phosphite ions are accumulated in the plating bath but also sodium ions and sulfate ions are accumulated in the plating bath. In this case, since sodium sulfate has a high solubility, it exerts only a slight effect on the plating film.

However, as a result of regenerating and reusing the electroless nickel plating bath by adding nickel sulfate to precipitate the accumulated phosphite ions as nickel phosphite in accordance with the above-described manner and separating the nickel phosphite from the plating bath, the amount of sodium sulfate exceeds a value equivalent to the solubility and crystals of the sodium sulfate are precipitated. The sodium sulfate precipitate exerts adverse effect on the characteristics of the plated film.

Accordingly, it is recommended that the electroless nickel plating bath from which nickel phosphite is separated is cooled at a temperature lower than room temperature (20° C.) as needed to precipitate sodium sulfate and the precipitated sodium sulfate is removed. Thus, it becomes possible to regenerate and reuse the plating bath by effectively removing the phosphite ions accumulated in the plating bath, and also to simply, positively remove, without inclusion of any impurity, sodium sulfate accumulated in a large amount by repeatedly regenerating the plating bath. The removal of the sodium sulfate is thus effective to further prolong the service life of the electroless plating bath. The plating bath, therefore, can be repeatedly used for a longer period of time.

The timing of the above treatment depending on the accumulated amount of sodium sulfate may be suitably selected. For example, the treatment may be performed when the accumulated amount of sodium sulfate becomes a value in the range of 200 g/l or more, particularly, 400 g/l or more and less than the solubility of sodium sulfate. The cooling temperature is not particularly limited, but it may be in the range of 0° to 15° C., preferably, 0° to 5° C. When the cooling temperature is lower than the lower limit, the plating bath may ice; while when it is higher than the upper limit, the removed amount at once is reduced. The removal of sodium sulfate can be performed by the conventional crystallization technique.

The resulting sodium sulfate can be used as a raw material for the above-described procedure of reaction (ii).

The plating bath from which sodium sulfate is separated is adjusted in terms of the plating composition in accordance with the same manner as described above, and is reused.

Next, the recycle flow of an electroless nickel plating bath in accordance with the method of the present invention will be described with reference to FIG. 1.

Referring to FIG. 1, there are shown a plating zone A and a regenerating zone B. Reference numeral 1 indicates an electroless nickel plating tank in which an electroless nickel plating bath is contained. The electroless nickel plating bath mainly contains nickel sulfate, a complexing agent for complexing nickel sulfate, and sodium hypophosphite as a reducing agent for reducing nickel sulfate. The pH of the plating bath is adjusted to be usually in the range of 3.5 to 6.5, particularly, in the range of 4 to 6.

As plating proceeds, since the concentrations of nickel ions and hypophosphite ions and the pH in the electroless nickel plating bath are lowered, the electroless nickel plating bath is transferred to a supply tank 2. At the supply tank 2, nickel sulfate and sodium hypophosphite are added for adjusting the concentrations of the nickel ions and hypophosphite ions at specific values and also a pH adjusting agent (typically, sodium hydroxide) is added for adjusting the pH at a specific value. The electroless nickel plating bath thus adjusted is then returned to the plating tank 1. The additional supply of nickel sulfate, sodium hypophosphite, and sodium hydroxide may be performed continuously or intermittently in the supply tank 2, and in some cases, it may be directly performed in the plating tank 1 without provision of the supply tank 2.

The continuous plating with nickel sulfate, sodium hypophosphite, and sodium hydroxide additionally supplied in the electroless nickel plating bath increases the amount of phosphite ions as described above. The plating bath in which the amount of the phosphite ions is increased, is regenerated in the regenerating zone B.

Specifically, the electroless nickel plating bath with the increased phosphite ions is transferred to a tank 3. At the tank 3, sodium hydroxide is added for adjusting the pH of the plating bath in the range of 7 to 10, preferably, in the range of 8 to 9, whereby $H_2PO_3^-$ is converted into $HPO_3^{2-}$.

Next, the plating bath thus adjusted in terms of the pH is transferred to a phosphite ion separation tank 4. At the tank 4, nickel sulfate is added in the plating bath at a temperature of 30° to 100° C., preferably, 70° to 90° C., whereby the phosphite ions $HPO_3^{2-}$ are precipitated as nickel phosphite $NiHPO_3$ which is in turn separated from the plating bath. The plating bath from which the phosphite ions are separated is then transferred to a sodium sulfate separation tank 6 by way of a tank 5. At the tank 6, the excess amount of sodium sulfate (which is produced mainly from the additionally supplied nickel sulfate and sodium hydroxide as a pH adjusting agent) is removed. Separation of sodium sulfate can be performed by cooling the plating bath at a temperature lower than room temperature, preferably, in the range of 0° to 5° C. to crystallize the sodium sulfate, and separating the crystallized sodium sulfate from the plating bath. In the case where sodium sulfate is contained in the plating bath only in a small amount, the separating operation thereof can be omitted.

The plating bath from which sodium sulfate is separated is transferred to a supply tank 7 for adjusting the composition of the plating bath for regeneration. At the tank 7, nickel sulfate and sodium hypophosphite, and also a complexing agent (as needed) are added to adjust their concentrations. A pH adjusting agent (typically, NaOH) is also added to adjust the pH of the plating bath. The plating bath thus adjusted in the tank 7 is transferred to the tank 2 at which the composition of the plating bath is re-adjusted as needed, and is then returned into the tank 1.

On the other hand, the nickel phosphite $NiHPO_3$ separated in the phosphite ion separation tank 4 is transferred to a nickel phosphite treating tank 8. At the tank 8, sulfuric acid or a mixture of sulfuric acid and sodium sulfate is added to dissolve the nickel phosphite therein. The sodium sulfate obtained in the sodium sulfate separation step can be used when a mixture of sulfuric acid and sodium sulfate is used. The nickel phosphite dissolved in sulfuric acid or the mixture of sulfuric acid and sodium sulfate is then transferred to a nickel sulfate separation tank 9 at which it is converted into nickel sulfate and phosphorous acid or $NaH_2PO_3$ as described above. The nickel sulfate thus separated is recovered in a nickel sulfate recovery tank 10, and it is further transferred from the tank 10 to the phosphite ion separation tank 4. At the tank 4, the nickel sulfate is used as a raw material for converting phosphite ions into nickel phosphite. The phosphorous acid or $NaH_2PO_3$ separated in the tank 9 is discharged out of the system.

According to the above-described method, nickel sulfate used for removing phosphite ions and, in some cases, sodium sulfate used for the treatment of nickel phosphite can be regenerated and reused, and consequently, the cost required for electroless nickel plating can be significantly reduced, and further contamination of the plating bath by addition of a foreign chemical can be eliminated. Also, according to the above-described recycle flow, it is possible to substantially eliminate waste water which is troublesome for treatment because it contains a large amount of a complexing agent. This is advantageous in that the complexing agent can be used without wastage, the cost for water treatment is reduced, and the environmental protection can be effectively ensured.

The present invention will be more clearly understood with reference to the following example:

EXAMPLE

An electroless nickel plating bath having the following composition was prepared.

| | |
|---|---|
| nickel sulfate | 5.0 g/l (as $Ni^{2+}$) |
| $NaH_2PO_2.H_2O$ | 25.0 g/l |
| sodium acetate | 18.0 g/l |
| malic acid | 40.0 g/l |
| $Pb^{2+}$ | 0.3 mg/l |
| ($NaH_2PO_3$ | 0 g/l) |
| pH | 4.5 |

Electroless nickel plating was performed at 90° C. using the above electroless nickel plating bath, with nickel sulfate, $NaH_2PO_2 \cdot H_2O$, and NaOH (or $H_2SO_4$) as a pH adjusting agent being added at specific intervals such that the concentrations of $Ni^{2+}$ and $NaH_2PO_2 \cdot H_2O$ and the pH were kept constant at the respective levels shown above. Sodium acetate, malic acid, and $Pb^{2+}$ were added as needed. When the amount of phosphite ions was increased over a specific value, nickel sulfate was added to remove the phosphite ions. Then, the plating was continued in the same manner as described above. After that, the plating bath was analyzed. The results are shown as follows:

| | |
|---|---|
| $Ni^{2+}$ | 5.0 g/l |
| $NaH_2PO_2.H_2O$ | 25.0 g/l |
| $NaH_2PO_3$ | 205 g/l |
| $Na_2SO_4.7H_2O$ | 430 g/l |
| $Pb^{2+}$ | 0.3 mg/l |

Next, the plating bath was left as it was at 5° C. for one hour, and the sodium sulfate crystal was removed by filtration. The plating bath thus obtained was analyzed. The results are shown as follows:

| | |
|---|---|
| $Ni^{2+}$ | 5.0 g/l |
| $NaH_2PO_2.H_2O$ | 24.3 g/l |
| $NaH_2PO_3$ | 203 g/l |
| $Na_2SO_4.7H_2O$ | 110 g/l |
| $Pb^{2+}$ | 0.3 mg/l |

Nickel sulfate was added to the plating bath having the pH of 4.5 such that the concentration of nickel sulfate in the plating bath was adjusted at 30 g/l. After that, the plating bath was left at 95° C. for one hour. The precipitation thus produced was removed. The resulting plating bath was analyzed. The results are shown as follows:

| | |
|---|---|
| $Ni^{2+}$ | 9.0 g/l |
| $NaH_2PO_2.H_2O$ | 7.3 g/l |
| $NaH_2PO_3$ | 99 g/l |
| $Na_2SO_4.7H_2O$ | 106 g/l |
| $Pb^{2+}$ | 0.1 mg/l |

As for the plating bath, the concentrations of $Ni^{2+}$ and $NaH_2PO_2 \cdot H_2O$ were adjusted at 5.0 g/l and 25 g/l, respectively, and the pH was adjusted at 4.5. Using such a plating bath, plating was performed at 90° C. for 30 minutes. As a substrate to be plated, a mild steel sheet having a size of 5 cm×10 cm was used, and the amount of the plating bath was set at one liter. The plating film was subjected to visual inspection. It was observed that the electroless Ni—P alloy plated film exhibited a desirable appearance without undesirable defect on the surface thereof. As a result of leaving the plating film in washing water for one hour, it was revealed that no rust was observed on the surface of the plated film.

While the preferred embodiment has been described using specific terms, such description is for illustrative purposes only, and it is to be understood that changes and variations may be made without departing from the spirit or scope of the following claims.

We claim:

1. A method of treating an electroless plating bath containing hypophosphorous acid and/or a hypophosphite as a reducing agent, comprising the steps of:

adding a water-soluble nickel salt to said electroless plating bath in which phosphite ions are accumulated to produce and precipitate nickel phosphite, and separating said nickel phosphite from said plating bath; and adding sulfuric acid or a mixture of sulfuric acid and sodium sulfate to said nickel phosphite separated from said plating bath to convert said nickel phosphite into nickel sulfate and phosphorous acid or $NaH_2PO_3$, and recovering said nickel sulfate.

2. A method of treating an electroless nickel plating bath mainly containing a water-soluble nickel salt, a complexing agent for complexing said nickel salt, and sodium hypophosphite as a reducing agent for reducing said nickel salt, comprising the steps of:

repeatedly regenerating and reusing said electroless nickel plating bath in which a phosphite is accumulated by adding nickel sulfate to said plating bath to produce and precipitate nickel phosphite and separating said nickel phosphite from said plating bath; and adding sulfuric acid or a mixture of sulfuric acid and sodium sulfate to said nickel phosphite separated from said plating bath to convert said nickel phosphite into nickel sulfate and phosphorous acid or $NaH_2PO_3$, and recovering said nickel sulfate.

3. A method according to claim 2, wherein said nickel sulfate recovered by adding sulfuric acid or the mixture of sulfuric acid and sodium sulfate to said nickel phosphite is used as a raw material to be added to said plating bath for converting said phosphite into said nickel phosphite.

4. A method according to claim 2 or 3, wherein said plating bath from which said nickel phosphite is separated is cooled to a temperature lower than room temperature to precipitate sodium sulfate from said plating bath, and said sodium sulfate is separated from said plating bath.

5. A method according to claim 4, wherein the separated sodium sulfate is used as a raw material for converting nickel phosphite to $NaH_2PO_3$.

* * * * *